US009976529B2

(12) United States Patent
Mechi et al.

(10) Patent No.: US 9,976,529 B2
(45) Date of Patent: May 22, 2018

(54) VALVE ASSEMBLY FOR AN INJECTION VALVE AND INJECTION VALVE

(71) Applicant: Continental Automotive GmbH, Hannover (DE)

(72) Inventors: Marco Mechi, Vada (IT); Roberto Ricci, Livorno (IT); Nicola Iannaccone, Pisa (IT); Luigi Gargiulo, Pisa (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 192 days.

(21) Appl. No.: 14/368,012

(22) PCT Filed: Dec. 13, 2012

(86) PCT No.: PCT/EP2012/075354
§ 371 (c)(1),
(2) Date: Jun. 23, 2014

(87) PCT Pub. No.: WO2013/092366
PCT Pub. Date: Jun. 27, 2013

(65) Prior Publication Data

US 2015/0060573 A1 Mar. 5, 2015

(30) Foreign Application Priority Data

Dec. 21, 2011 (EP) ..... 11194762

(51) Int. Cl.
*F02M 61/14* (2006.01)
*F02M 61/16* (2006.01)
*F02M 61/04* (2006.01)

(52) U.S. Cl.
CPC ..... *F02M 61/04* (2013.01); *F02M 61/14* (2013.01); *F02M 61/16* (2013.01); *F02M 2200/16* (2013.01); *F02M 2200/858* (2013.01)

(58) Field of Classification Search
CPC ..... F02M 61/04; F02M 61/14; F02M 61/16; F02M 2200/16; F02M 2200/858
(Continued)

(56) References Cited

U.S. PATENT DOCUMENTS 5,044,340 A 9/1991 Robnett ..... 123/470
6,009,856 A * 1/2000 Smith, III ..... F02M 61/14 123/470
(Continued)

FOREIGN PATENT DOCUMENTS

CN 1459002 A 11/2003 ..... F02M 51/06
DE 10321163 A1 12/2004 ..... B23P 11/00
(Continued)

OTHER PUBLICATIONS

Chinese Office Action, Application No. 201280063515.5, 13 pages, dated Oct. 26, 2015.
(Continued)

*Primary Examiner* — Christopher Kim
*Assistant Examiner* — Cody Lieuwen
(74) *Attorney, Agent, or Firm* — Slayden Grubert Beard PLLC

(57) ABSTRACT

A valve assembly for an injection valve includes a valve body with a central longitudinal axis, the valve body having a valve body groove extending circumferentially around the valve body and being designed to take in a gasket, the valve body groove having a first wall section and a second wall section, the wall sections configured to be coupled to the gasket in a manner that the valve assembly is sealingly coupable with a cylinder head of a combustion engine, and an injection nozzle enabling a fluid flow through the valve assembly. The second wall section is arranged relative to the first wall section in axial direction away from the injection nozzle. The first wall section extends to a first radius and the
(Continued)

second wall section extends to a second radius, and the first radius is bigger than the second radius.

12 Claims, 3 Drawing Sheets

(58) Field of Classification Search
USPC ..... 239/86–92, 95, 96, 533.2–533.12, 239/584–585.5; 123/470; 285/104, 108, 285/113, 349
See application file for complete search history.

(56) References Cited

U.S. PATENT DOCUMENTS

| | | | | |
|---|---|---|---|---|
| 6,615,802 | B2 | 9/2003 | Reiter et al. | 123/470 |
| 6,921,035 | B2 * | 7/2005 | Hohl | F02M 51/0671 239/533.2 |
| 7,721,713 | B2 * | 5/2010 | Hayatani | F02M 51/0685 123/467 |
| 2002/0179057 | A1 * | 12/2002 | Reiter | F02M 51/0671 123/472 |
| 2004/0080115 | A1 * | 4/2004 | Tsuchiya | F02M 61/14 277/458 |

FOREIGN PATENT DOCUMENTS

| | | | | |
|---|---|---|---|---|
| EP | 1357284 | A1 | 10/2003 | F02M 61/14 |
| EP | 2080893 | A1 * | 7/2009 | F02M 61/14 |
| WO | 02/12717 | A1 | 2/2002 | F02M 51/06 |
| WO | 2013/092366 | A1 | 6/2013 | F02M 61/14 |

OTHER PUBLICATIONS

International Search Report and Written Opinion, Application No. PCT/EP2012/075354, 9 pages, dated Feb. 25, 2013.
Chinese Office Action, Application No. 201280063515.5, 11 pages, dated May 30, 2016.

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2012/075351 filed Dec. 13, 2012, which designates the United States of America, and claims priority to EP Application No. 11194762.8 filed Dec. 21, 2011, the contents of which are hereby incorporated by reference in their entirety.

TECHNICAL FIELD

The invention relates to a valve assembly for an injection valve and an injection valve.

BACKGROUND

This patent application claims the priority of European patent application No. 11194762.8, the disclosure content of which is hereby incorporated by reference.

Injection valves are in wide spread use, in particular for internal combustion engines where they may be arranged in order to dose fuel into an intake manifold of the internal combustion engine or directly into the combustion chamber of a cylinder of the internal combustion engine. Fuel can be supplied to the internal combustion engine by the injection valve. The injection valves can be coupled to the cylinder head of the internal combustion engine in different manners.

The coupling of the injection valves to the cylinder head needs to be very precise to get a correct injection angle.

SUMMARY

One embodiment provides a valve assembly for an injection valve, comprising a valve body with a central longitudinal axis, the valve body having a valve body groove extending circumferentially around the valve body and being designed to take in a gasket, the valve body groove having a first wall section and a second wall section, the wall sections being designed to be coupled to the gasket in a manner that the valve assembly is sealingly coupable to a cylinder head of a combustion engine, and an injection nozzle enabling a fluid flow through the valve assembly, wherein the second wall section is arranged relative to the first wall section in axial direction away from the injection nozzle, and the first wall section extends to a first radius and the second wall section extends to a second radius, and the first radius is bigger than the second radius.

In a further embodiment, the first wall section and/or the second wall section are shaped as cylindrical lateral surfaces.

In a further embodiment, the distance between a bottom surface of the groove and the central longitudinal axis monotonically increases in the course towards the injection nozzle.

In a further embodiment, the groove has a bottom surface which extends, in axial direction towards the injection nozzle, from an upper side surface to a lower side surface, the first and second wall sections are comprised by the bottom surface, and the distance between the bottom surface and the central longitudinal axis monotonically increases in the course from the upper side surface to the first wall section and monotonically decreases in the further course to the lower side surface.

In a further embodiment, the valve body has a radially extending protrusion being arranged axially between the first wall section and the second wall section, the protrusion extending to a third radius, the third radius being larger than the first radius.

In a further embodiment, the second wall section has a larger axial extension than the first wall section.

In a further embodiment, the second wall section has a larger axial extension than the first wall section.

Another embodiment provides an injection valve comprising a valve assembly having any or all of the features disclosed above.

BRIEF DESCRIPTION OF THE DRAWINGS

Example embodiments of the invention are explained below with reference to the drawings, in which.

Elements of the same design and/or function that occur in different illustrations are identified by the same reference character.

DETAILED DESCRIPTION

Figure 1:
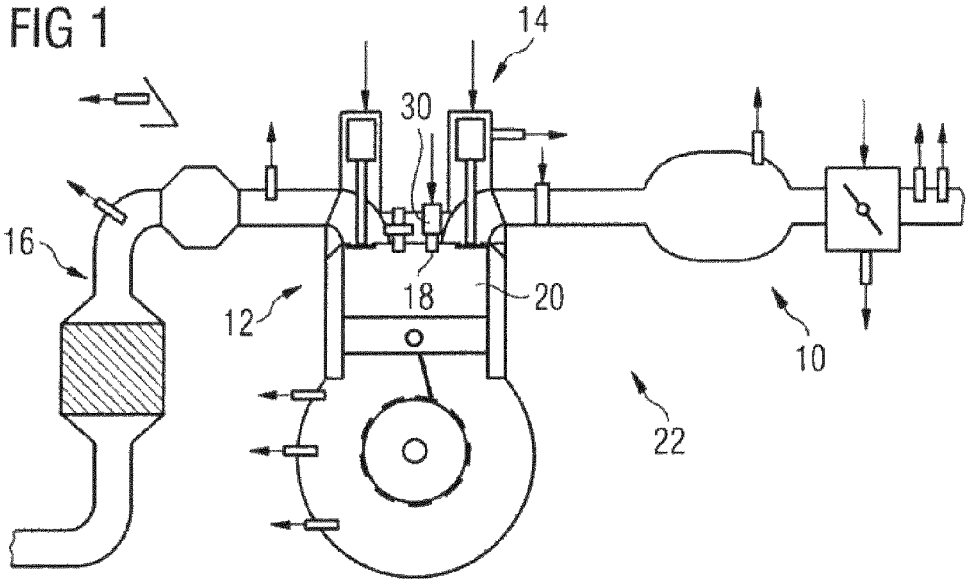
FIG. 1 shows an internal combustion engine in a schematic view.

Embodiments of the invention to specify a valve assembly for an injection valve being sealingly coupleable to a cylinder head of a combustion engine which is simply to be manufactured and which facilitates a reliable and precise coupling between the valve assembly and the cylinder head of the combustion engine.

Other embodiments of the invention specify an injection valve that ensures a precise dosing of fuel.

According to one aspect, a valve assembly for an injection valve is specified. According to another aspect, an injection valve comprising the valve assembly is specified.

The valve assembly comprises a valve body with a central longitudinal axis. The valve body has a valve body groove extending circumferentially around the valve body and being designed to take in a gasket. In particular, the groove extends in axial direction from an upper side surface to a lower side surface. In other words, the axial extension of the groove may be defined and limited by the lower and upper side surfaces. A bottom surface of the groove may extend from the upper side surface to the lower side surface.

The valve body groove has a first wall section and a second wall section. The first and second wall sections are in particular sections of the bottom surface of the groove. In one embodiment, the first wall section has an interface with the lower side wall and/or the second wall section has an interface with the upper side wall. In the present context, an "interface" is in particular a common edge. The first and second wall sections may be designed to be coupled to the gasket in a manner that the valve assembly is sealingly coupable to a cylinder head of a combustion engine.

The valve assembly comprises an injection nozzle enabling a fluid flow through the valve assembly. The second wall section is arranged relative to the first wall section in axial direction away from the injection nozzle. In particular, also the upper side surface is arranged relative to the lower side surface in axial direction away from the injection nozzle. For example, the upper side surface, the second wall section, the first wall section and the first side surface follow each other in this order in axial direction towards the injection nozzle. The first wall section extends to a first radius and the second wall section extends to a second radius, and the first radius is bigger than the second radius.

This has the advantage that a secure sealing coupling of the valve assembly in the cylinder head is possible as a high pressure contact of the gasket relative to the valve body and the cylinder head may be obtained. In particular, a high pressure contact between the first wall section and the gasket may be obtained. Consequently, movements of the gasket inside the valve body groove in particular in axial direction may be avoided. Therefore, an extrusion of the gasket from the valve body groove may be avoided. Furthermore, the valve body groove can take in sections of the gasket in the case of a thermal expansion of the gasket, in particular inside the valve body groove adjacent to the second wall section of the valve body. Additionally, the volume of the gasket which may be exposed to high temperatures during the operation of the injection valve may be kept small.

In a further embodiment the first wall section and/or the second wall section are shaped as cylindrical lateral surfaces. This has the advantage that the wall sections may be manufactured in a very simple manner. In addition, a particularly large volume of the groove for accommodating the gasket is achievable in this way.

In one embodiment, the distance between the bottom surface of the groove and the central longitudinal axis monotonically increases in the course towards the injection nozzle. In another embodiment, the distance between the bottom surface of the groove and the central longitudinal axis monotonically increases in the course from the upper side surface to the first wall section and monotonically decreases in the further course tow the lower side surface. In yet another embodiment, the valve body has a radially extending protrusion being arranged axially between the first wall section and the second wall section, the protrusion in particular extending to a third radius which is larger than both the first and the second radius.

The volume of the gasket which may be exposed to high temperatures during the operation of the injection valve may be kept particularly small in these embodiments. The valve body with the radially extending protrusion also may have the advantage that the protrusion forms a further obstacle against an extrusion of the gasket from the valve body groove.

In one embodiment, the second wall section has a larger axial extension than the first wall section. In this way, a particularly large volume for accommodating the gasket is achievable in a portion of the groove remote from the injection nozzle. This may reduce the risk of the gasket being damaged due to exposure of to high temperatures.

FIG. 1 shows an internal combustion engine 22, with an intake air tract 10, a motor block 12, a cylinder head 14 and an exhaust gas tract 16. In the motor block 12 a combustion chamber 20 is arranged.

The cylinder head 14 comprises an injection valve 18. The cylinder head 14 has a recess 15 which may take up at least parts of the injection valve 18. A sealing arrangement 30 enables the sealing of the injection valve 18 in the cylinder head 14 of the combustion engine 22.

Figure 2:
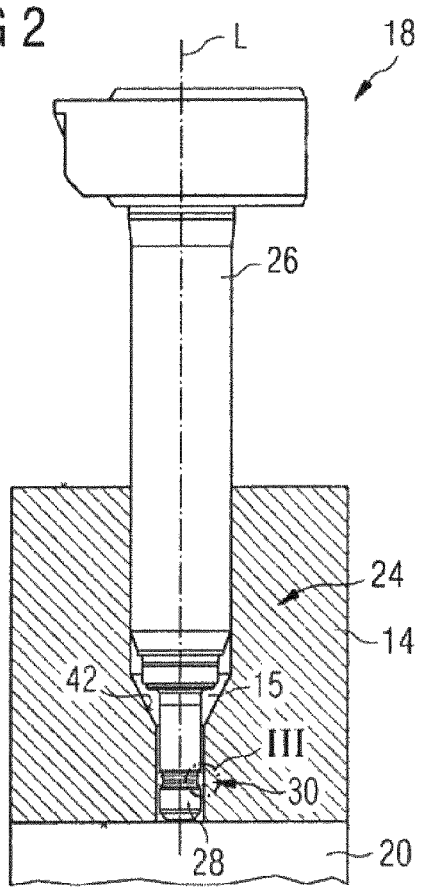
FIG. 2 shows an injection valve with a valve assembly and a cylinder head in a longitudinal section view.

The fuel injector 18 is designed to be coupled to a high-pressure fuel chamber of the internal combustion engine 22. The fuel injector 18 (FIGS. 1 and 2) comprises a valve assembly 24. Furthermore, the injection valve 18 is designed to be coupled to an electrical supply to actuate a not shown actuator unit of the injection valve 18.

Figure 3:
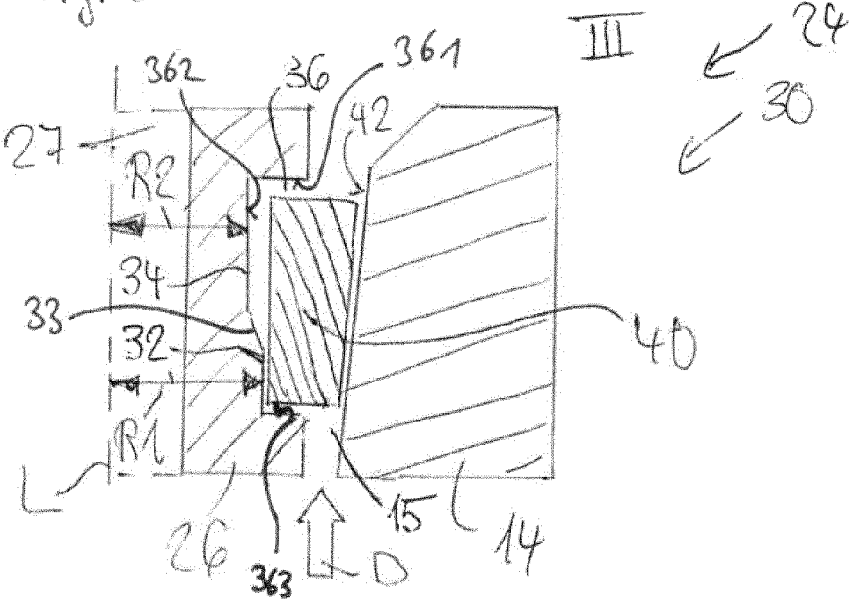
FIG. 3 shows a cut-out III of FIG. 2 with the valve assembly according to a first embodiment.
Figure 4:
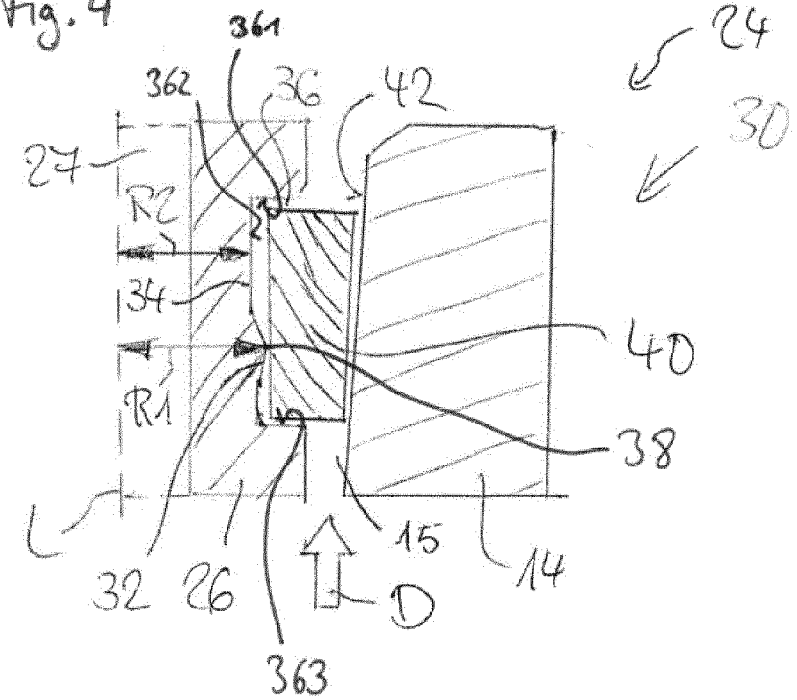
FIG. 4 shows a further embodiment of the valve assembly.
Figure 5:
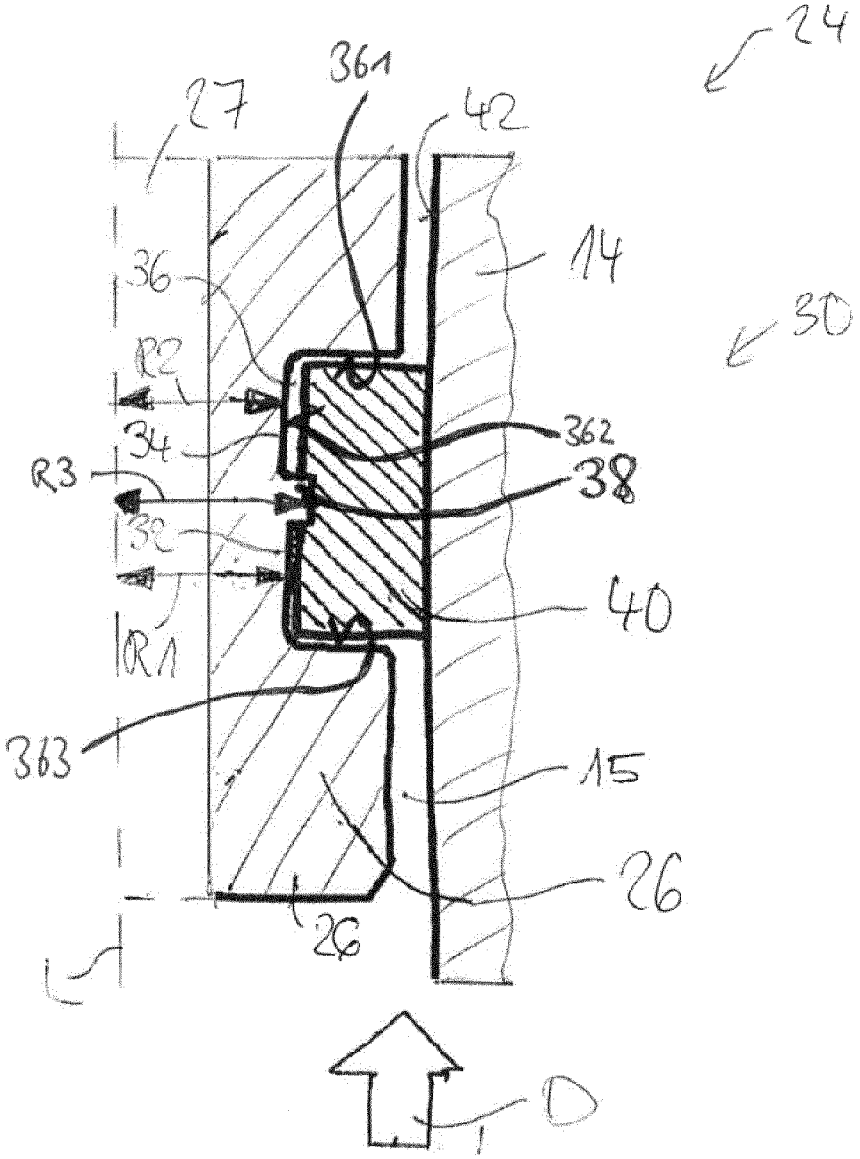
FIG. 5 shows a further embodiment of the valve assembly.

The valve assembly 24 comprises a valve body 26 with a central longitudinal axis L and a cavity 27 which is axially led through the valve body 26 (FIGS. 3 to 5). The valve assembly 24 further comprises a not shown valve needle taken in the cavity 27 of the valve body 26. On a free end of the valve assembly 24 an injection nozzle 28 is formed which is closed or opened by an axial movement of the valve needle. In a closing position a fuel flow through the injection nozzle 28 is prevented. In an opening position fuel can flow through the injection nozzle 28 into the combustion chamber 20 of the internal combustion engine 22.

As can be seen in FIGS. 3 to 5 the valve body 26 has a valve body groove 36 with a first wall section 32 and a second wall section 34. In particular the groove has a bottom surface 362 extending from an upper side surface 361 at a first axial end of the groove 36 to a lower side surface 363 at an opposite, second axial end of the groove 36. The first and second wall sections 32, 34 are in particular sections of the bottom surface 362. The first wall section 32 and the second wall section 34 are part of the sealing arrangement 30. The first wall section 32 and the second wall section 34 are parts of the valve body 26 and are arranged circumferentially around the valve body 26.

The first wall section 32 and the second wall section 34 may have a circular shape. The first wall section 32 and the second wall section 34 may form cylindrical surfaces with their centres on the central longitudinal axis L (FIGS. 3 and 5). In an alternative embodiment, the first wall section 32 and/or the second wall section 34 may form a truncated conical surface (see, for example, the first wall section 32 in FIG. 4).

The first wall section 32 and the second wall section 34 are arranged axially distanced from each other in the embodiments of FIGS. 3, 4 and 5. The second wall section 34 is arranged in a larger distance from the injection nozzle 28 than the first wall section 32. The second wall section 34 may have a larger axial extension than the first wall section 32.

In the embodiment of FIG. 3, the bottom surface 362 of the groove 36 is composed of a cylindrical first wall section 32, a truncated conical intermediate wall section 33, and a cylindrical second wall section 34. In the course towards the injection nozzle 28 from the upper side surface 361 to the lower side surface 363, the distance of the bottom surface 362 from the central longitudinal axis L increases monotonically. Specifically, it is constant from the upper side surface 361 to the interface between the second wall section 34 and the intermediate wall section 33, increases in the course from this interface to the interface between the intermediate wall section 33 and the first wall section 32 and is constant from the latter interface to the lower side surface 363.

In the embodiment of FIG. 4, the bottom surface 362 of the groove 36 is composed of a truncated conical first wall section 32, a truncated conical intermediate wall section 33, and a cylindrical second wall section 34. The first wall section 32 and the intermediate wall section 33 are arranged in such fashion that their bases face towards each other. In this way, the first wall section 32 and the intermediate section 33 may form a circumferential flange **38*a*** having a V-shaped cross section.

The distance between the bottom surface 362 and the central longitudinal axis L monotonically increases in the course from the upper side surface 361 to the first wall section 32 and monotonically decreases in the further course to the lower side surface 363. Specifically, in the course towards the injection nozzle 28, the distance of the bottom surface 362 from the central longitudinal axis L increases monotonically from the upper side surface 361 towards an interface of the intermediate section 33 with the first wall section 32 and monotonically decreases from this interface to the lower side surface 363. In particular, the distance is constant from the upper side surface 361 to the interface between the second wall section 34 and the intermediate wall section 33, increases in the course from this interface to the interface between the intermediate wall section 33 and the first wall section 32 and decreases from the latter interface to the lower side surface 363.

In the embodiment of FIG. 5, a protrusion 38*b* is arranged axially between the first wall section 32 and the second wall section 24. In this embodiment, the bottom surface 362 is composed of the cylindrical first wall section 32, the protrusion 38*b*, and the cylindrical second wall section 34. The protrusion 38*b* extends to a third radius R3 which is larger than each of the first radius R1 and the second radius R2. In one development, the protrusion 38*b* has a cylindrical shape.

The recess 15 of the cylinder head 14 and the valve body groove 36 take in a gasket 40 which is arranged between the wall sections 32, 34 of the valve body 26 and an inner wall 42 of the recess 15 of the cylinder head 14. In view of a good recognizability, FIGS. 3 and 4 show the gasket 40 being distanced from the wall sections 32, 34 and the inner wall 42 in contrary to the effective conditions wherein the gasket 40 is in sealing contact with the wall sections 32, 34 and the inner wall 42. The gasket 40 may be formed from a material which comprises PTFE which is suited to the temperatures usually occurring in the internal combustion engine 22.

The first wall section 32 has a first radius R1 and the second wall section 34 has a second radius R2 relative to the central longitudinal axis L of the valve body 26. The first radius R1 is bigger than the second radius R2. By this a high contact pressure between the first wall section 32 and the gasket 40 as well as between the gasket 40 and the cylinder head 14 is available.

In the following, the sealing function of the valve assembly 24 will be described in detail:

During the operation of the internal combustion engine 22, the temperatures in the cylinder head 14 and in the valve body 26 usually decrease in a direction D of the stream of the hot exhaust gases. Consequently, the area of the first wall section 32 and its adjacent area of the gasket 40 are usually exposed to a higher temperature than the second wall section 34 and its adjacent area of the gasket 40.

During operation of the internal combustion engine 22, usually the first wall section 32 and the second wall section 34 together with the gasket 40 and the cylinder head 14 have a sealing function. Thus, an exit of the hot exhaust gases in the combustion chamber 20 in direction D through the recess 15 in the cylinder head 14 which takes up the injection valve 18 may be prevented.

The first radius R1 of the first wall section 32 is larger than the second radius R2 of the second wall section 34. Consequently, the contact pressure between the first wall section 32 and the gasket 40 may be very high. In particular, the contact pressure between the first wall section 34 and the gasket 40 may be very high in the case of a thermal expansion of the gasket 40. This makes it possible to obtain a good sealing function between the valve body 26 and the cylinder head 14. The high contact pressure between the first wall section 32 and the gasket 40 may prevent movements of the gasket 40 inside the valve body groove 36 relative to the valve body 26 and the cylinder head 14 in particular in axial direction. This may prevent that the gasket 40 extrudes from the valve body groove 36.

A further advantage of the described valve assembly 24 is that in case of a thermal expansion of the gasket 40 the valve body groove 36 can take in sections of the gasket 40 in particular inside a section of the valve body groove 36 adjacent to the second wall section 34 of the valve body 26.

The temperatures during the operation of the internal combustion engine 22 may be very high and hot exhaust gases may stream in direction D towards the gasket 40. By this the gasket 40 may be exposed to the hot gases. As the first radius R1 of the first wall section 32 is large compared to the second radius R1 of the second wall section 32 the volume of the valve body groove 36 adjacent to the first wall section 32 may be kept small. Consequently, the volume of the gasket 40 exposed to the hot gases may be kept small.

The protrusion 38 of the embodiment of FIG. 5 being arranged axially between the first wall section 32 and the second wall section 34 together with the gasket 40 may provide a further sealing function between the valve body 26 and the cylinder head 14 and a locking function for the gasket 40 inside the valve body groove 36.

The invention claimed is:

1. A valve assembly for an injection valve, comprising:

a valve body with a central longitudinal axis, a gasket surrounding a circumference of the valve body, a valve body groove extending circumferentially around an outside surface of the valve body adjacent an injection nozzle and configured to take in the gasket, the valve body groove having:

a first wall section having a first width measured parallel the central longitudinal axis and a first radius measured radially from the central longitudinal axis, the first radius having a first constant value at every point along the first width;

a second wall section having a second width measured parallel the central longitudinal axis and a second radius measured radially from the central longitudinal axis, the second radius having a second constant value at every point along the second width;

the first and second wall section separated by a circumferential flange section having a third width measured parallel the central longitudinal axis; and the second constant value smaller than the first constant value;

the gasket extending radially beyond the first radius and the second radius such that the valve assembly is sealingly coupleable to a cylinder head of a combustion engine and the gasket not extending axially beyond a combined width of the valve body groove equal to the sum of the first width, the second width, and the third width, and the injection nozzle enabling a fluid flow through the valve assembly, wherein the second wall section is arranged relative to the first wall section away from the injection nozzle in an axial direction.

2. The valve assembly of claim 1, wherein at least one of the first wall section and the second wall section define cylindrical lateral surfaces.

3. The valve assembly of claim 1, wherein:

the groove has a bottom surface that extends from an upper side surface to a lower side surface towards the injection nozzle in the axial direction, the first and second wall sections are defined by the bottom surface, and a distance between the bottom surface and the central longitudinal axis monotonically increases along a direction from the upper side surface to the first wall section and monotonically decreases along a direction toward the lower side surface.

4. The valve assembly of claim 1, wherein the circumferential flange extends to a third radius that is larger than the first radius.

5. The valve assembly of claim 1, wherein the width of the second wall section is larger than the width of the first wall section.

6. The valve assembly of claim 1, wherein the width of the second wall section is smaller than the width of the first wall section.

7. An injection valve comprising:

a valve assembly comprising:

a valve body with a central longitudinal axis, a gasket surrounding a circumference of the valve body, a valve body groove extending circumferentially around an outside surface of the valve body adjacent an injection nozzle and configured to take in the gasket, the valve body groove having:

a first wall section with a first width measured parallel to the central longitudinal axis and a first radius measured radially from the central longitudinal axis; and a second wall section with a second width measured parallel to the central longitudinal axis and a second radius measured radially from the central longitudinal axis;

the first and second wall section separated by a circumferential flange section having a third width measured parallel to the central longitudinal axis, the gasket extending radially beyond the first radius and the second radius such that the valve assembly is sealingly coupleable to a cylinder head of a combustion engine and the gasket not extending beyond a combined width of the valve body groove equal to the sum of the first width, the second width, and the third width, and the injection nozzle enabling a fluid flow through the valve assembly, wherein the second wall section is arranged relative to the first wall section away from the injection nozzle in an axial direction, and wherein the first radius has a first constant value and the second radius has a second constant value smaller than the first constant value.

8. The injection valve of claim 7, wherein at least one of the first wall section and the second wall section define cylindrical lateral surfaces.

9. The injection valve of claim 7, wherein:

the groove has a bottom surface that extends from an upper side surface to a lower side surface towards the injection nozzle in the axial direction, the first and second wall sections are defined by the bottom surface, and a distance between the bottom surface and the central longitudinal axis monotonically increases along a direction from the upper side surface to the first wall section and monotonically decreases along a direction toward the lower side surface.

10. The injection valve of claim 7, wherein the circumferential flange section comprises a flat cylindrical wall extending to a third radius that is larger than the first radius.

11. The injection valve of claim 7, wherein the width of the second wall section is larger than the width of the first wall section.

12. The injection valve of claim 7, wherein the width of the second wall section is smaller than the width of the first wall section.

* * * * *